US011794225B2

(12) United States Patent
Hassan

(10) Patent No.: US 11,794,225 B2
(45) Date of Patent: Oct. 24, 2023

(54) RADIUS SCRAPER

(71) Applicant: Mohamed Alamin Mustafa Hassan, Stephens City, VA (US)

(72) Inventor: Mohamed Alamin Mustafa Hassan, Stephens City, VA (US)

( * ) Notice: Subject to any disclaimer, the term of this patent is extended or adjusted under 35 U.S.C. 154(b) by 163 days.

(21) Appl. No.: 17/509,186

(22) Filed: Oct. 25, 2021

(65) Prior Publication Data

US 2022/0126335 A1 Apr. 28, 2022

Related U.S. Application Data

(60) Provisional application No. 63/105,452, filed on Oct. 26, 2020.

(51) Int. Cl.

| | |
|---|---|
| ***B08B 9/08*** | (2006.01) |
| ***A47L 13/06*** | (2006.01) |
| ***A47L 13/08*** | (2006.01) |

(52) U.S. Cl.

CPC ..... *B08B 9/0808* (2013.01); *A47L 13/06* (2013.01); *A47L 13/08* (2013.01); *B08B 9/0804* (2013.01)

(58) Field of Classification Search

CPC ..... A47L 13/02; A47L 13/06; A47L 13/08; B08B 9/08; B08B 9/0804; B08B 9/0808; B05C 17/10; B44D 3/105

USPC ..... 15/236.07; 294/50, 50.5

See application file for complete search history.

(56) References Cited

U.S. PATENT DOCUMENTS

| | | | | | |
|---|---|---|---|---|---|
| 2,961,817 | A * | 11/1960 | Mitchell | A01D 44/00 | 56/8 |
| 3,344,863 | A * | 10/1967 | Hastings | A01G 3/00 | 294/51 |
| 5,033,156 | A * | 7/1991 | Stewart | B25B 33/00 | 15/105 |
| 5,345,642 | A * | 9/1994 | Faldetta | A47L 17/06 | 15/236.05 |
| 5,799,997 | A * | 9/1998 | Lehn | A47L 13/022 | 294/181 |
| 6,611,983 | B1 * | 9/2003 | Hopey | E01H 5/00 | 15/104.03 |
| 6,676,181 | B1 * | 1/2004 | Greiner | A47J 43/288 | 294/7 |
| 7,958,651 | B2 * | 6/2011 | Maniha | F26B 25/003 | 34/604 |
| 8,321,989 | B1 * | 12/2012 | McClanahan | B44D 3/162 | 15/236.01 |
| 2002/0175526 | A1 * | 11/2002 | Stevenson | B28C 5/4203 | 294/176 |
| 2006/0272117 | A1 * | 12/2006 | Crisswell | E04F 21/162 | 15/236.08 |
| 2013/0104331 | A1 * | 5/2013 | Leis | A47L 13/34 | 15/236.07 |

* cited by examiner

*Primary Examiner* — Randall E Chin

(74) *Attorney, Agent, or Firm* — Benjamin C. Rothermel, Esq.

(57) ABSTRACT

A radius scraper includes a semicircular-shaped scraper having a curved front face, the curved front face having vertical grooves formed in a bottom edge thereof. Wires are respectively threaded into each of the vertical grooves, wherein the wires are braided steel wire.

1 Claim, 8 Drawing Sheets

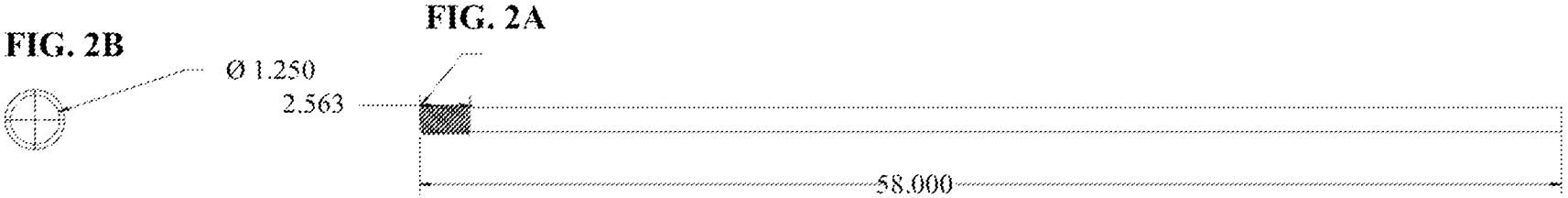
FIG. 2A
58.000
2.563
Ø 1.250
FIG. 2B
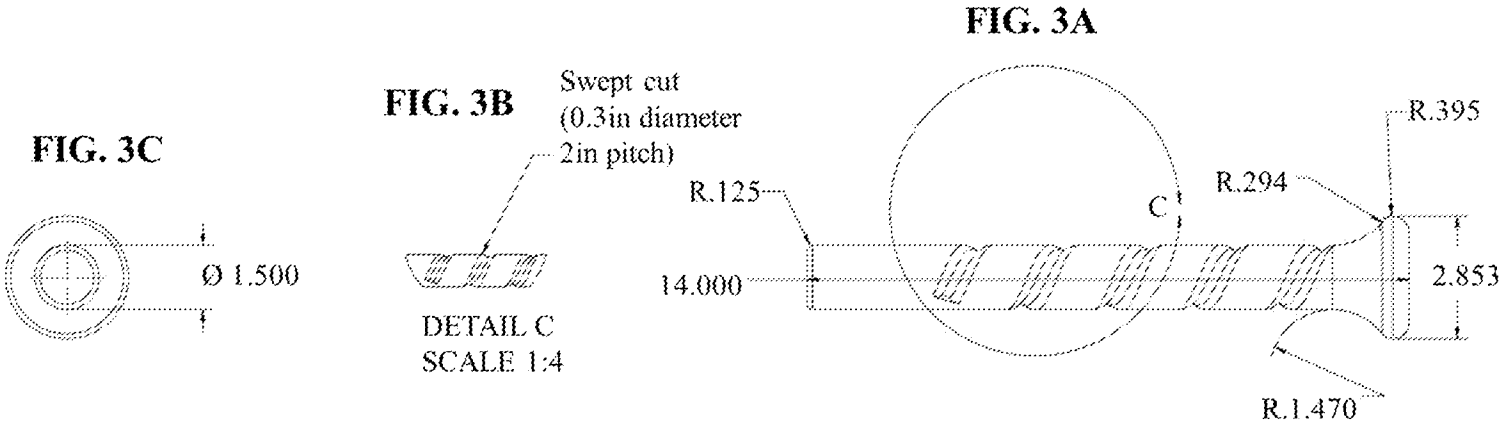
FIG. 3A
R.395
2.853
R.294
R.1.470
C
R.125
14.000
FIG. 3B
Swept cut
(0.3in diameter
2in pitch)
DETAIL C
SCALE 1:4
FIG. 3C
Ø 1.500

RADIUS SCRAPER

The radius scraper according to exemplary embodiments may be used for scraping concrete, such as on chutes and extensions on the rear of a concrete mixer truck. This invention may solve economic, labor, and environmental issues. Economically, it may reduce the need and consumption of various harmful chemicals that are used for a variety of reasons in the concrete industry. Labor wise, it may replace a standard round point shovel for cleaning and removing concrete from chutes. In addition, it may reduce cleaning efforts for scraping concrete in hard to reach areas. It may eliminate the need for workers to climb or access around a truck, thus reducing labor. Environmentally speaking, reducing the consumption of concrete affiliated chemicals may reduce the contamination of land, and reduces the risk of unsolicited exposure to humans, animals, and work sites Due to environmental reasons, washing and maintaining the concrete mixer chutes may only be allowed when the truck is inside a metal box enclosure or an insulated hole is present, underneath. If a driver or contractor does not abide by these rules, consequences may result in large fines and jail time. The chemicals used in the concrete industry may pose a high risk and endanger the safety and health of workers, animals, aquatic life, and land.

According to exemplary embodiments, residential and commercial concrete construction companies may benefit from reduced labor times, thus increasing the rate of productivity of concrete mixer drivers, reducing consumption of concrete based chemicals, and reducing the risk of unsolicited exposure for humans, animals, and land environment.

BRIEF DESCRIPTION OF THE DRAWINGS

The accompanying drawings, which are included to provide a further understanding of the inventive concept, and are incorporated in an constitute a part of this specification, illustrate exemplary embodiments of the inventive concept, and, together with the description, serve to explain principles of the inventive concept.

FIG. 2A is a side view of a rod of the radius scraper according to the present exemplary embodiment;

FIG. 2B is a front view of the rod according to the present exemplary embodiment;

FIG. 3A and FIG. 3B are side views of a handle of the radius scraper according to the present exemplary embodiment;

FIG. 3C is a front view of the handle according to the present exemplary embodiment;

DETAILED DESCRIPTION OF THE ILLUSTRATED EMBODIMENTS

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

The radius scraper according to the present exemplary embodiment is a mechanical tool that may be controlled with human effort. As shown in FIG. 1, FIG. 2A, FIG. 2B, FIG. 3A, FIG. 3B, FIG. 3C, FIG. 4A, FIG. 4B, FIG. 4C, FIG. 5A, FIG. 5B, FIG. 6A, FIG. 6B, and FIG. 7, the radius scraper 10 includes two main sub-assemblies: a rod/handle, and hemispherical sheet plate assembly with steel braided wire attached.

Figure 1:
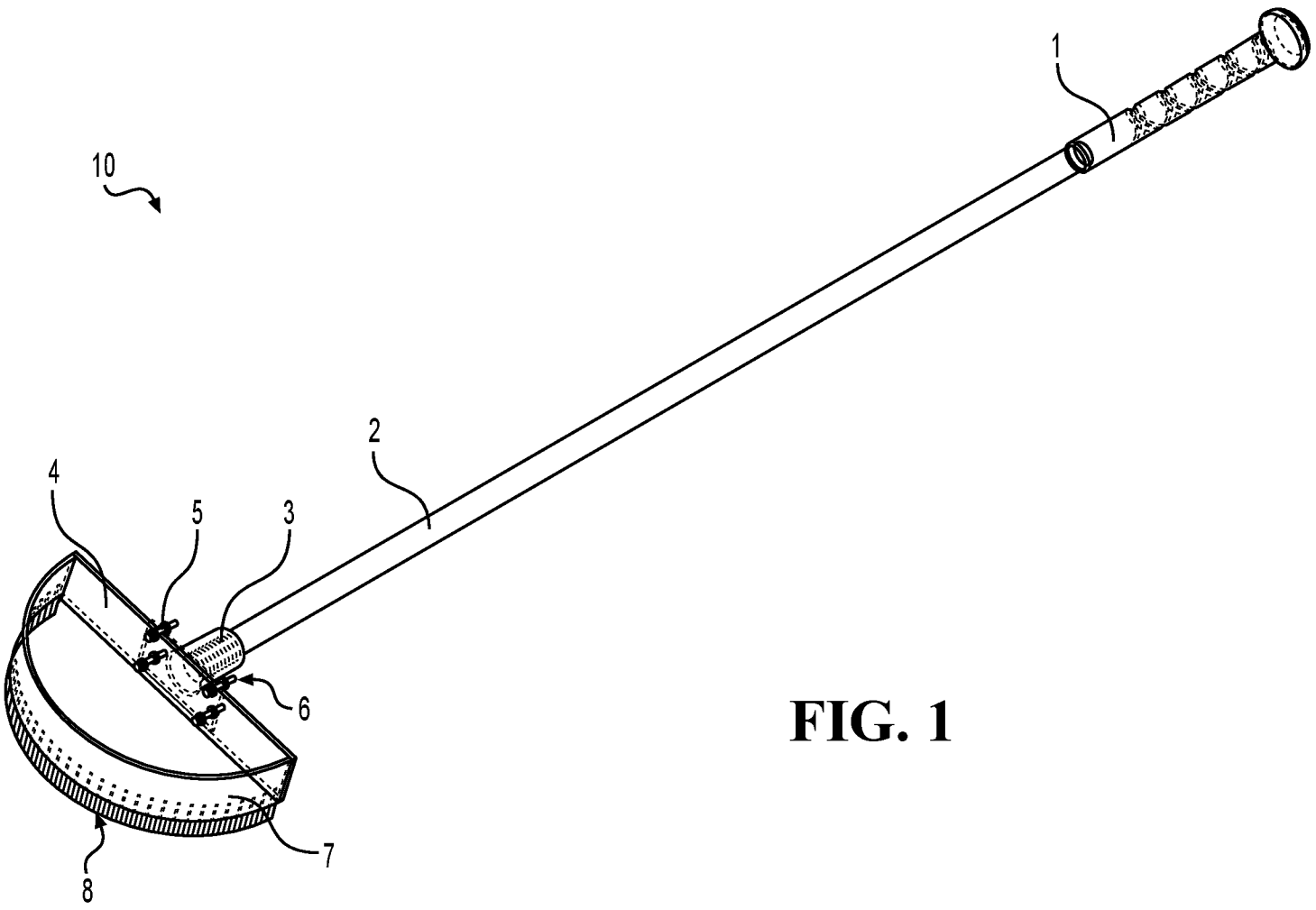
FIG. 1 is a perspective view of a radius scraper according to an exemplary embodiment.
Figure 4A:
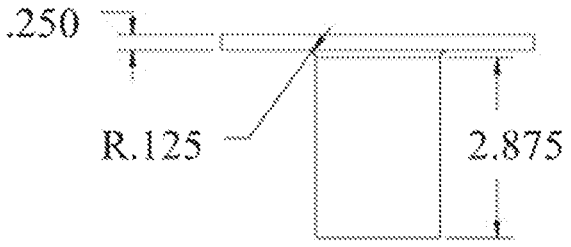
FIG. 4A is a side view of a coupler of the radius scraper according to the present exemplary embodiment.
Figure 4B:
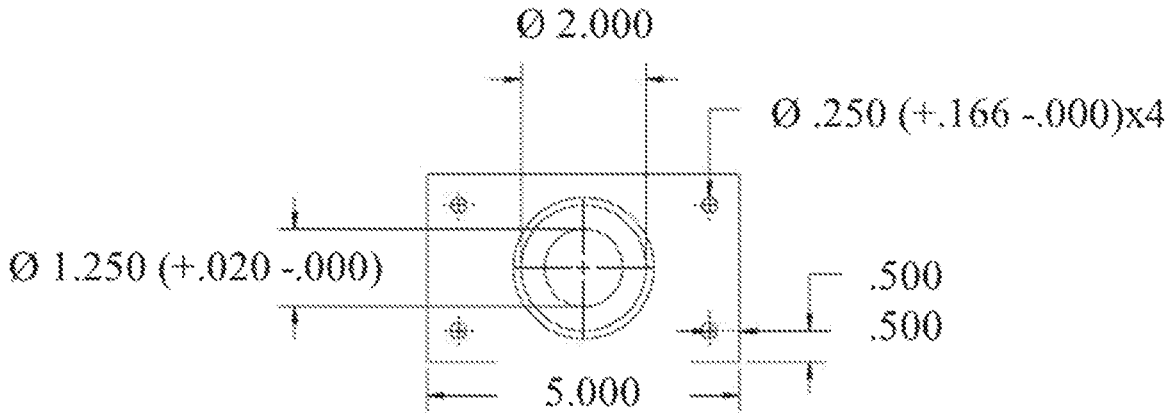
FIG. 4B is a front view of the coupler of the radius scraper according to the present exemplary embodiment.
Figure 4C:
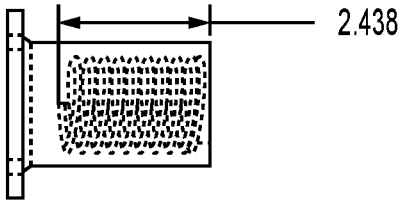
FIG. 4C is a cross-sectional view of the coupler according to the present exemplary embodiment.
Figure 5A:
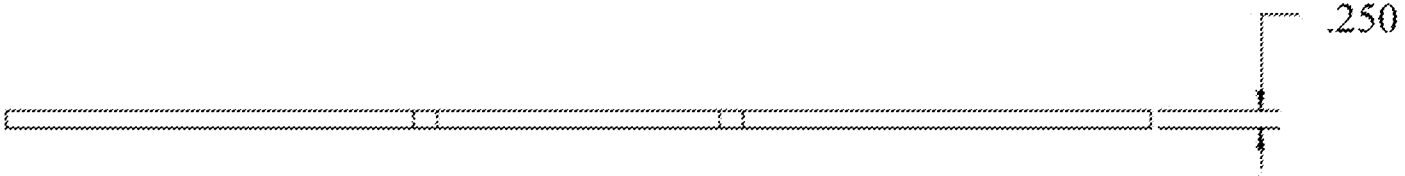
FIG. 5A is a side view of a brace of the radius scraper according to the present exemplary embodiment.
Figure 5B:
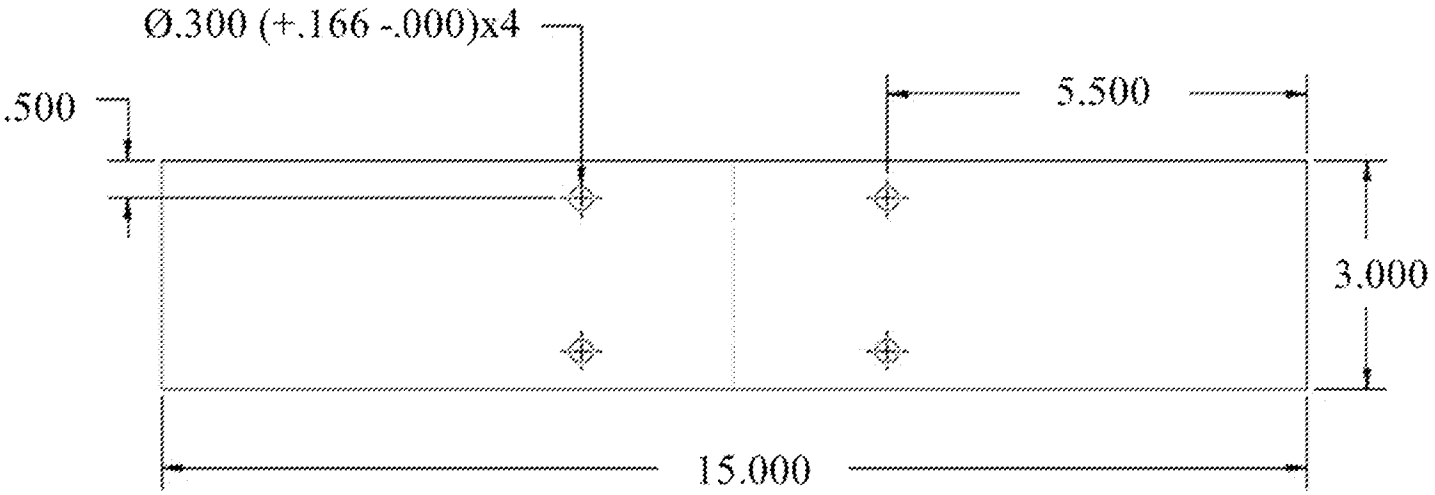
FIG. 5B is a front view of the brace according to the present exemplary embodiment.

The handle 1 is connected to the rod 2, as shown in FIG. 1, FIG. 2A, FIG. 2B, FIG. 3A, FIG. 3B, and FIG. 3C. The end of the handle 1 has a greater diameter than the diameter than the handle body and the rod 2. The handle 1 is made of solid high-density polyvinyl chloride (PVC), and has a swept cut therein. The rod 2 is made of steel. The end of the rod 2, opposite the end connecting to the handle 1, is threaded. As shown in FIG. 1 and FIG. 4C, a coupler 3 has threading to accommodate the threaded end of the rod 2.

As shown in FIG. 4A, FIG. 4B, FIG. 4C, FIG. 5A, and FIG. 5B, the coupler 3 is connected to a brace 4 via bolts 5 and screws 6, which are all made of steel. There are four screw holes in the coupler 3 and brace 4 to accommodate the screws 6.

Figure 6C:
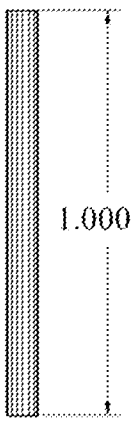
FIG. 6C is a side view of a wire of the radius scraper according to the present exemplary embodiment.
Figure 6D:
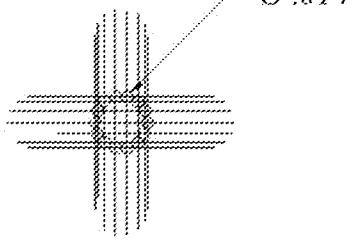
FIG. 6D is a cross-sectional view of the wire according to the present exemplary embodiment.
Figure 6A:
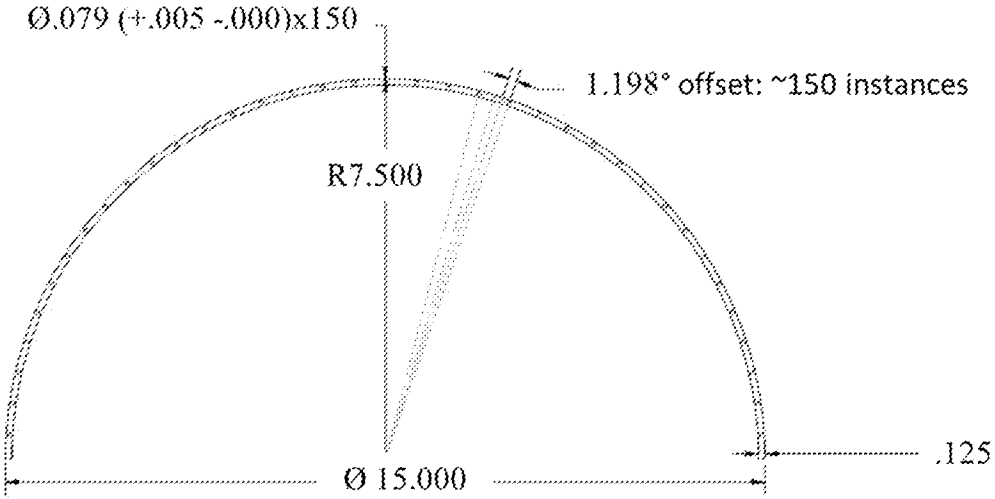
FIG. 6A is a side view of a scraper of the radius scraper according to the present exemplary embodiment.
Figure 6B:
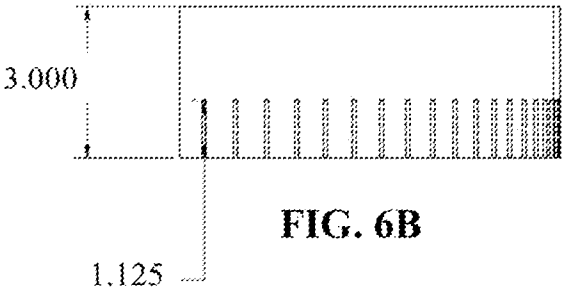
FIG. 6B is a cross-sectional view of the scraper according to the present exemplary embodiment.
Figure 7:
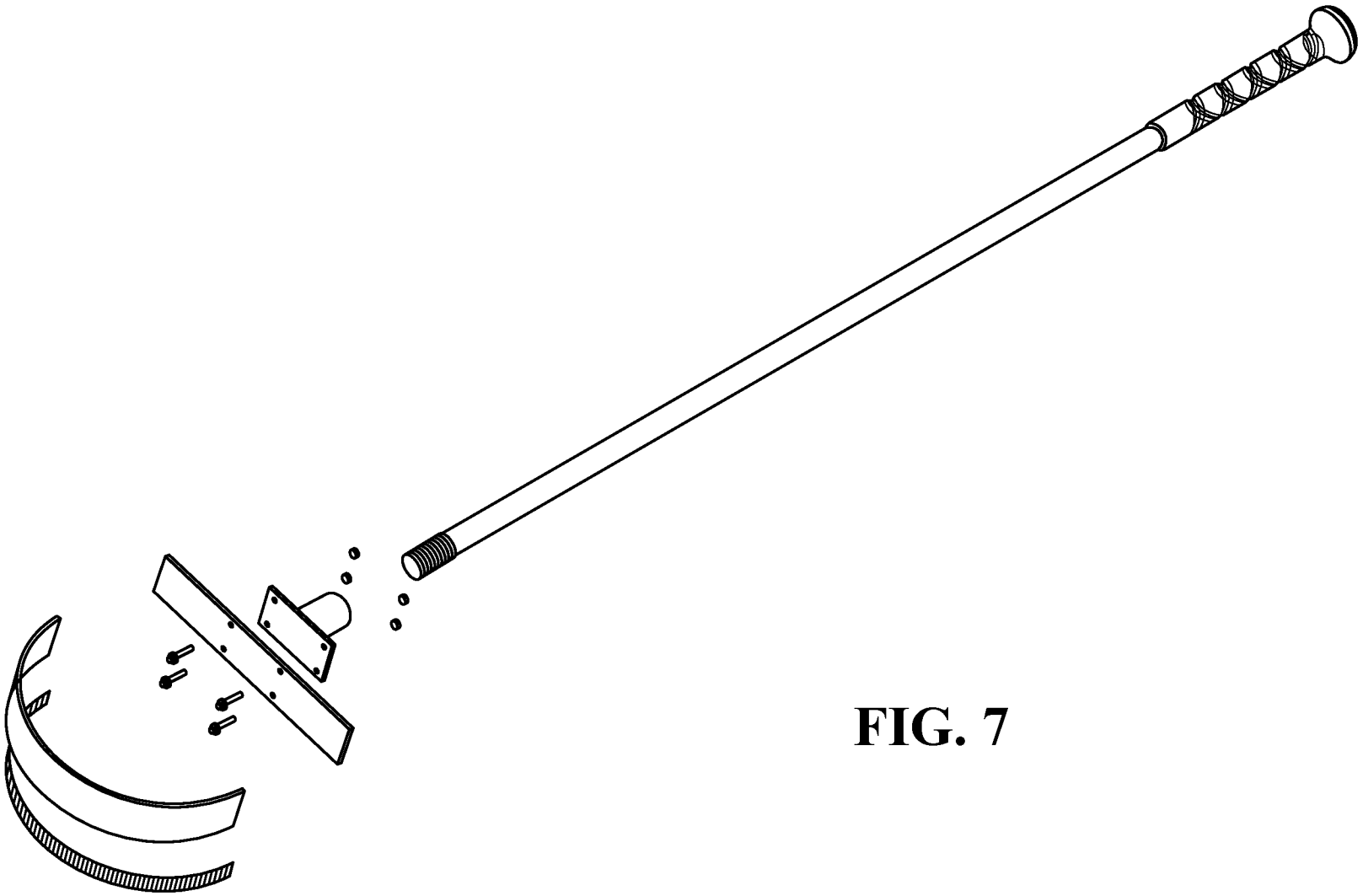
FIG. 7 is an exploded view of the radius scraper according to the present exemplary embodiment.

A scraper 7 is connected to the brace 4, as shown in FIG. 1, FIG. 6A, and FIG. 6B. According to the present exemplary embodiment, the brace 4 and scraper 7 are made of steel and are welded together. Wires 8 according to the present exemplary embodiment are made of braided steel, as shown in FIG. 1, FIG. 6C, and FIG. 6D. The wires 8 have approximately 150 rounds of braided steel wire. The wires 8 are threaded into vertical grooves in the scraper 7. The grooves are evenly spaced in the scraper 7.

The motion of the radius scraper 10 may be applied within eight degrees of freedom. The radius scraper 10 allows for pulling, pushing, and rotation to be applied, such as for scraping concrete. The hemispherical sheet plate assembly including the scraper 7 accommodates the conical and circular shape of concrete truck chutes. The hemispherical sheet plate assembly increases the amount of surface contact applied to the chutes. In addition, the closely grouped steel braided wire 8 is hard and stiff enough to absorb forces applied from a user, such as to scrape wet or dried concrete.

Figure 8B:
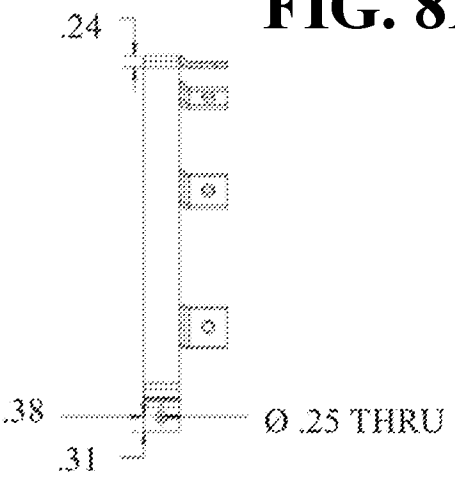
FIG. 8A, FIG. 8B, FIG. 8C, and FIG. 8D are top, side, front, and perspective views, respectively, of a wire clamp according to an exemplary embodiment.
Figure 8A:
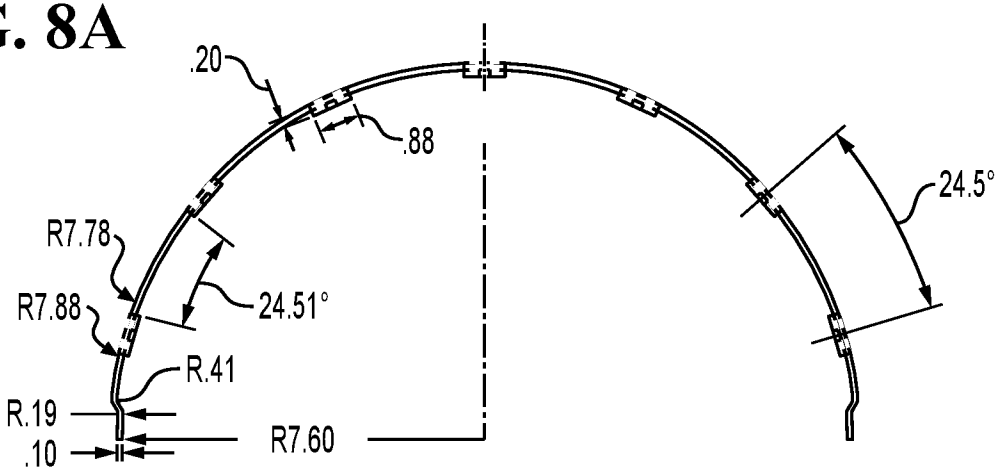
Figure 8C:
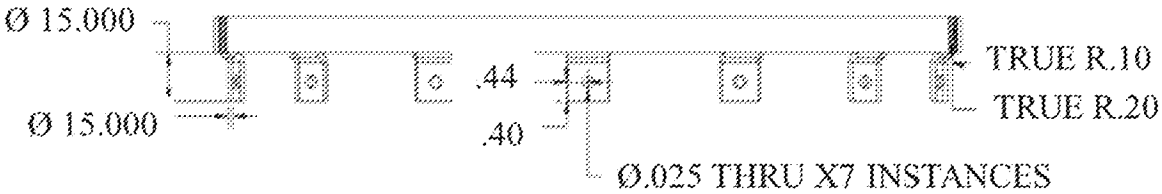
Figure 8D:
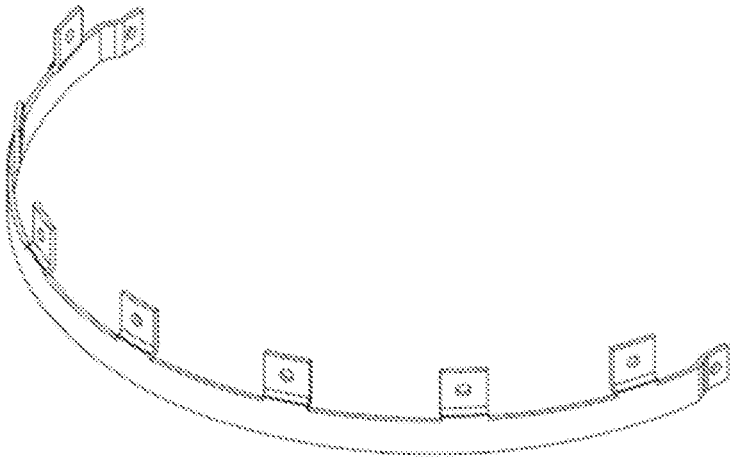
Figure 8E:
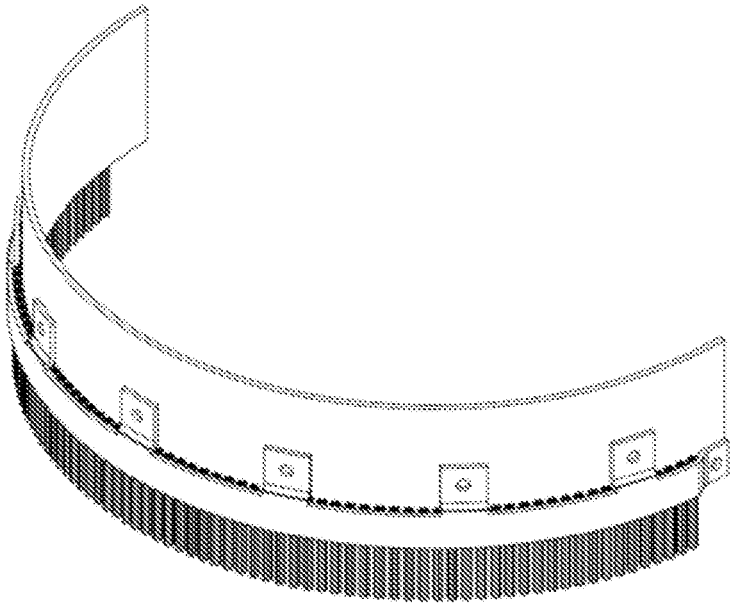
FIG. 8E is a perspective view of a scraper and the wire clamp according to the present exemplary embodiment.

A wire clamp is shown in FIG. 8A, FIG. 8B, FIG. 8C, and FIG. 8D, according to an exemplary embodiment. The wire clamp is connected to a scraper, as shown in FIG. 8E. The wire clamp may be connected to the scraper by bolts. The scraper may otherwise be substantially the same as the scraper 7 described above.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangement.

I claim:

1. A radius scraper, comprising:

a semicircular-shaped scraper having a curved front face, the curved front face comprising vertical grooves formed in a bottom edge thereof; and wires respectively threaded into each of the vertical grooves, wherein the wires comprise braided steel wire.

* * * * *